United States Patent [19]

Kobayashi

[11] Patent Number: 4,784,502

[45] Date of Patent: Nov. 15, 1988

[54] THERMAL PRINTER

[75] Inventor: Hiroshi Kobayashi, Iwate, Japan

[73] Assignee: Alps Electric Co., Ltd., Japan

[21] Appl. No.: 88,695

[22] Filed: Aug. 21, 1987

[30] Foreign Application Priority Data

Nov. 5, 1986 [JP] Japan ..... 170065[U]

[51] Int. Cl.[4] ..... B41J 35/04

[52] U.S. Cl. ..... 400/248; 400/697.1; 400/248.2; 400/120

[58] Field of Search ..... 400/248, 120, 696, 697, 400/697.1, 248.1, 248.2

[56] References Cited

U.S. PATENT DOCUMENTS

| | | | |
|---|---|---|---|
| 4,329,075 | 5/1982 | Applegate et al. | 400/248 |
| 4,396,308 | 8/1983 | Applegate et al. | 400/120 |
| 4,641,148 | 2/1987 | Dyer et al. | 400/120 |
| 4,650,351 | 3/1987 | Engle et al. | 400/235 |

FOREIGN PATENT DOCUMENTS

| | | | |
|---|---|---|---|
| 21287 | 2/1985 | Japan | 400/248.1 |

OTHER PUBLICATIONS

Craft "Ribbon Feed Mechanism", IBM Technical Disclosure Bulletin, vol. 27, No. 1A, pp. 204–207, 6–84.

Oleksa, "Printlead Assembly with Guide Bar", IBM Technical Disclosure Bulletin, vol. 27, No. 1A, pp. 209–211, 6–84.

*Primary Examiner*—William Pieprz

*Attorney, Agent, or Firm*—Guy W. Shoup; Paul J. Winters

[57] ABSTRACT

In a thermal printer including a thermal head, an ink ribbon interposed between the thermal head and a recording paper, the thermal head generating heat for effecting printing, and a movable ink ribbon guide for guiding the ink ribbon provided on a downstream side of the thermal head with respect to a scanning direction of the thermal head; the improvement comprising a drive source for driving the movable ink ribbon guide, and an elastic member provided in a path of transmission of a driving force to be transmitted from the drive source to the movable ink ribbon guide.

2 Claims, 5 Drawing Sheets

THERMAL PRINTER

BACKGROUND OF THE INVENTION

The present invention relates to a thermal printer suitable for a word processor and a typewritter, etc.

In a conventional thermal printer as disclosed in Japanese Patent Laid-open No. 58-31787, for example, an ink ribbon is interposed between a recording paper and a thermal head, and ink on the ink ribbon is molten by a heat generating means of the thermal head to thereby record characters and symbols, etc. onto the recording paper. Further, in erasing the record printed on the recording paper, an erasure energy is applied again to the ink ribbon, and the record is bonded to the ink ribbon, thus effecting the erasure. In the prior art, as the printing and the erasing operation are carried out by using a single ink ribbon, a peeling temperature of the ink ribbon from the recording paper is noticed. That is, in the printing operation, the ink ribbon is peeled off from the recording paper at high temperatures of the ink ribbon, while in the erasing operation, the ink ribbon is peeled off from the recording paper at low temperatures of the ink ribbon. The prior art device includes a movable ink ribbon guide designed to cooperate with an arm to be driven by a solenoid on the downstream side of the thermal head in a scanning direction. In the printing operation, the movable ink ribbon guide is separated from the recording paper so that the ink ribbon may be peeled off from the recording paper just after passing through the thermal head. In the erasing operation, the movable ink ribbon is pressed on the recording paper on the downstream side of the thermal head in the scanning direction so that the ink ribbon is maintained in contact with the recording paper for a certain period of time until the ink ribbon is cooled, even after passing through the heat generating means of the thermal head.

However, as the movable ink ribbon guide is operated simutaneously with the arm to be driven by the solenoid in the above conventional thermal printer, a quantity of movement of the movable ink ribbon guide is defined by a stroke of the solenoid. Accordingly, upon pressing the movable ink ribbon guide against the recording paper in the erasing operation, a pressure contact force is greatly changed with a change in thickness of the recording paper and surface roughness, for example.

Furthermore, an operation speed of the movable ink ribbon guide is substantially the same as that of the solenoid, which is very high. Accordingly, upon pressing the ink ribbon guide against the recording paper, such a high-speed operation causes the ink ribbon to be drawn extra from a ribbon cassette, resulting in slack or cut of the ink ribbon.

SUMMARY OF THE INVENTION

It is an object of the present invention to provide a thermal printer having a movable ink ribbon guide which may ensure a stable operation and a satisfactory pressure contact force to the recording paper.

According to the present invention, there is provided in a thermal printer including a thermal head, an ink ribbon interposed between the thermal head and a recording paper, the thermal head generating heat for effecting printing, and a movable ink ribbon guide for guiding the ink ribbon provided on a downstream side of the thermal head with respect to a scanning direction of the thermal head; the improvement comprising a drive source for driving the movable ink ribbon guide, and an elastic member provided in a path of transmission of a driving force to be transmitted from the drive source to the movable ink ribbon guide.

When the movable ink ribbon guide is pressed on the recording paper, the elastic member functions to absorb a change in thickness of the recording paper or surface roughness, thereby obtaining a satisfactory pressure contact force at all times.

Furthermore, even when the solenoid is operated at high speeds, the elastic member functions as a damper to soften the operation of the movable ink ribbon guide.

Other objects and features of the invention will be more fully understood from the following detailed description and appended claims when taken with the accompanying drawings.

DETAILED DESCRIPTION OF THE PREFERRED EMBODIMENT

Figure 1A:
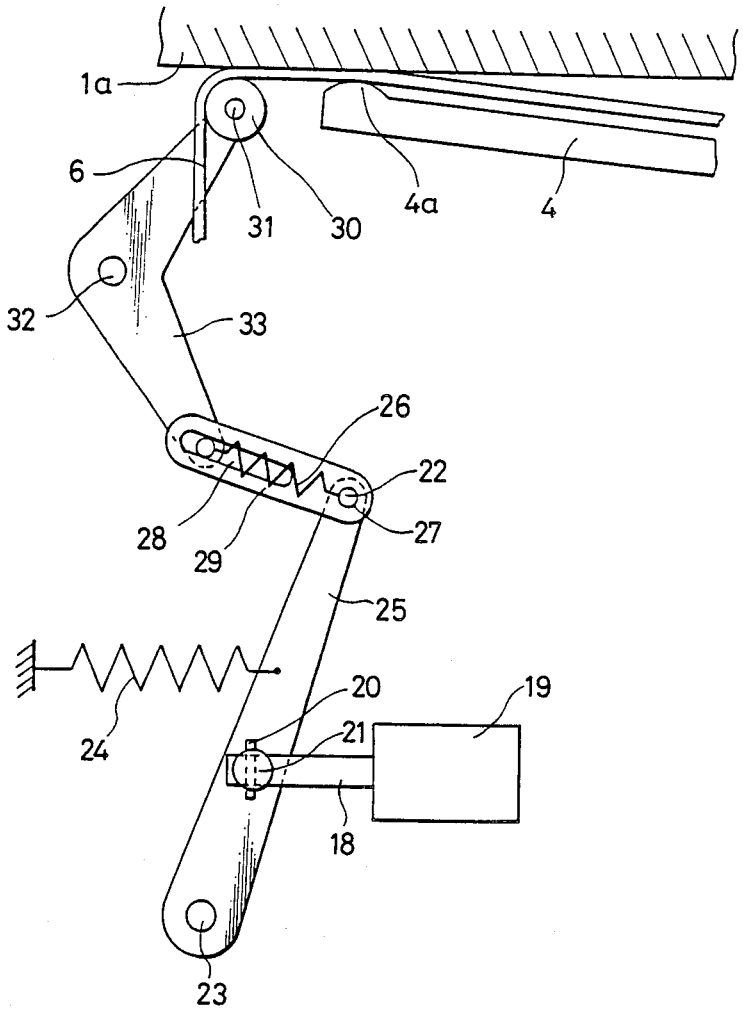
FIGS. 1A and 1B are plan views of the guide mechanism in the thermal printer under the ON and the OFF condition of the solenoid, respectively, in a preferred embodiment of the present invention.
Figure 1B:
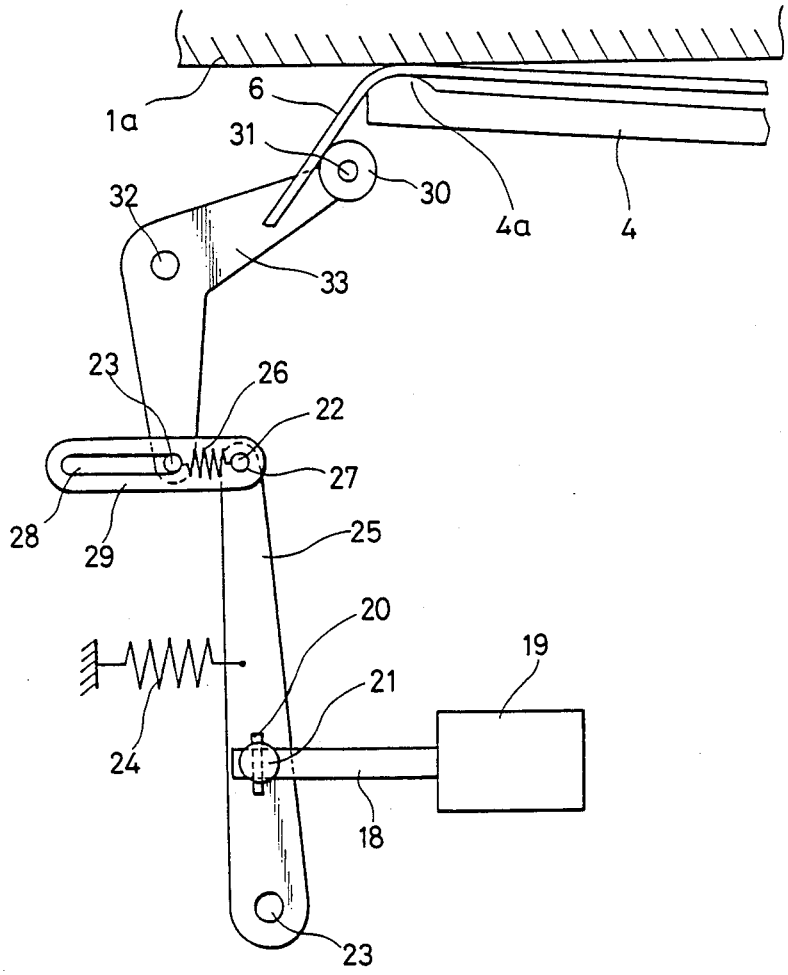
Figure 2:
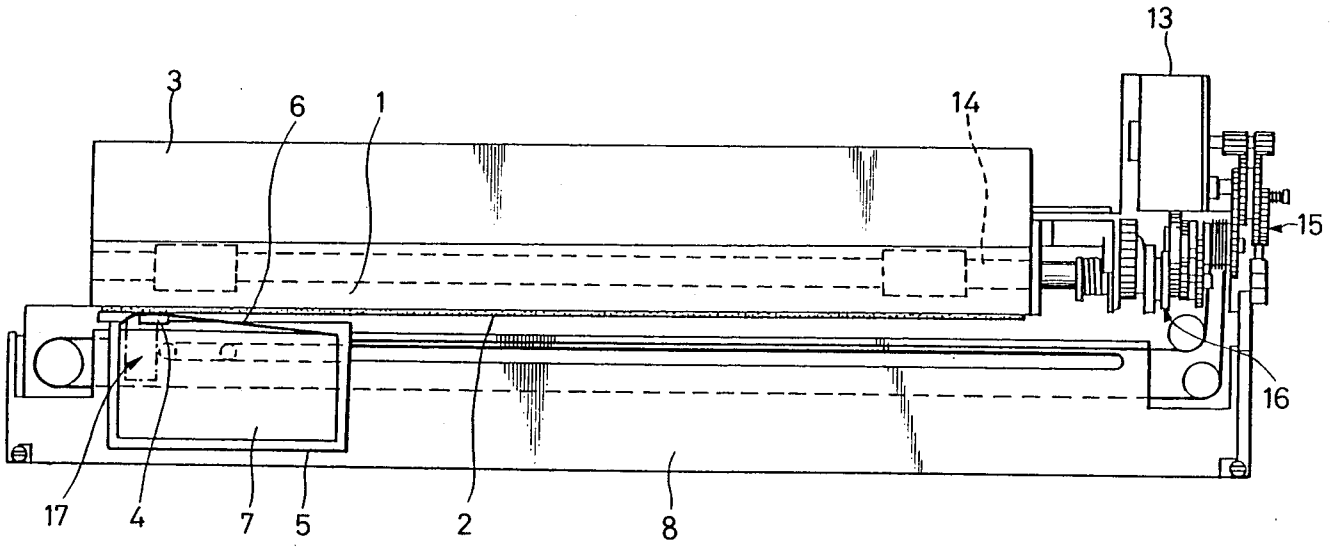
FIG. 2 is a plan view of the thermal printer.

Referring now to FIGS. 1A and 1B, FIG. 2 and FIGS. 3A and 3B, the thermal printer of the present invention includes a platen 1, a platen rubber 2 for determining a printing position, a recording paper 1*a* to be wound around the platen 1 and the platen rubber 2, a paper guide 3 for guiding the recording paper 1*a*, a thermal head 4 adapted to be opposed to the platen rubber 2 and having a plurality of heat generating elements 4*a*, a carriage 5 for mounting the thermal head thereon and adapted to move along the platen 1 rightwardly and leftwardly as viewed in FIG. 2, an ink ribbon 6 having a coloring agent interposed between the thermal head 4 and the recording paper 1*a*, a ribbon cassette 7 for receiving the ink ribbon 6 and adapted to be mounted in the carriage 5, a carriage retainer 8 for movably retaining the carriage 5, a pulse motor 13 serving as a drive source, a gear set 15 for transmitting a rotative force of the pulse motor 13, and a clutch mechanism 6 for selectively transmitting the rotative force transmitted from the pulse motor 13 to the gear set 15 to a rotating mechanism for a paper feeding shaft 14 for feeding the recording paper 1*a*.

There is further provided a guide mechanism 17 for the ink ribbon 6 at a predetermined position of the carriage 5 of the thermal printer on the downstream side of the ink ribbon 6. As shown in FIGS. 1A and 1B, the guide mechanism 17 comprises a solenoid 19 having a driving shaft 18, a lever 25 having a rotatable connecting shaft 21 connected to the driving shaft 18 by a pin 20 and having a first projection A22 at one end thereof, a first pivotal shaft 23 for pivotably supporting the lever 25 at the other end thereof, a lever return spring 24 for biasing the lever 25 counterclockwise, an arm 33 having a second projection B23 at one end thereof and having a rotating shaft 31 for rotatably supporting a ribbon guide roller 30 at the other end, a second pivotal shaft 32 for pivotably supporting the arm 33 at a central portion thereof, an arm driving spring 26 for driving the arm 33 engaged at its one end with the first projection A22 of the lever 25 and engaged at the other end with the second projection B23 of the arm 33, and a stopper 29 having a hole 27 at its one end for loosely engaging the first projection A22 and also having a slit 28 therein for slidably receiving the second projection B23.

Referring to FIG. 1B which shows a condition where the solenoid 19 is OFF, the lever 25 is rotated counterclockwise about the pivotal shaft 23 to a maximum stroke of the driving shaft 18 of the solenoid 19 by the tensile force of the lever return spring 24. The stopper 29 rotatably retained by the projection A22 of the lever 25 urges at the base of the slit 28 against the projection B23 of the arm 33 to thereby rotate the arm 33 clockwise about the pivotal shaft 32. Accordingly, the roller 30 rotatably supported at the other end of the arm 33 is separated from the recording paper 1*a*.

Referring next to FIG. 1A which shows a condition where the solenoid 19 is ON, the driving shaft 18 of the solenoid 19 is attracted into the solenoid 19 to rotate the lever 25 clockwise about the pivotal shaft 23 against the tensile force of the lever return spring 24. The projection A22 engaged with one end of the arm driving spring 26 is moved with the lever 25, but the projection B23 engaged with the other end of the arm driving spring 26 tends to stand sill owing to inertia of the arm 33. Accordingly, the arm driving spring 26 is extended from its natural length, and a tensile force of the spring 26 is applied to the projection B23 to thereby attractively move same and rotate the arm 33 counterclockwise. As a result, the roller 30 is brought into pressure contact with the recording paper 1*a*.

Figure 4:
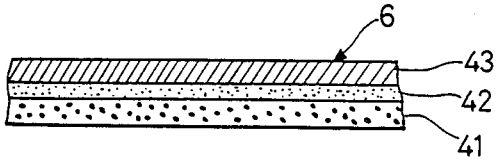
FIG. 4 is a cross sectional view of the ink ribbon.

There will now be described a construction of the ink ribbon 6 with reference to FIG. 4. An ink layer 41 is arranged opposably to the recording paper 1*a*. The ink layer 41 contains a coloring agent and additives in addition to a binder, and has a thickness of about 1–10 microns. A substantially transparent release layer 42 is formed on the ink layer 41. The release layer 42 contains a softening agent in addition to a wax or the like, and has a thickness of about 1–5 microns. The release layer 42 has a melting point or a softening point equal to that of the ink layer 41 and has a melt viscosity lower than that of the ink layer 41. A base layer 43 is formed on the release layer 42. The base layer 43 is formed of a plastic film having a thickness of about 3–12 microns. A bonding force between the ink layer 41 and the recording paper 1*a* is set in such that when the release layer 42 is molten, it is greater than an affinity between the ink layer 41 and the release layer 42 and a cohesive force of the release layer 42, while when the release layer 42 is solidified, it is smaller than the affinity and the cohesive force.

In operation, when the pulse motor 13 is driven to drive the gear set 15 and the clutch mechanism 16 and rotate the paper feeding shaft 14, the recording paper 1*a* is set in a printing position. At this time, a rotating mechanism (not shown) of the carriage 5 is operated to rotate the carriage 5 counterclockwise as shown in FIG. 3B, thereby maintaining the thermal head 4 in a head up condition where it is separated from the platen rubber 2.

Figure 3A:
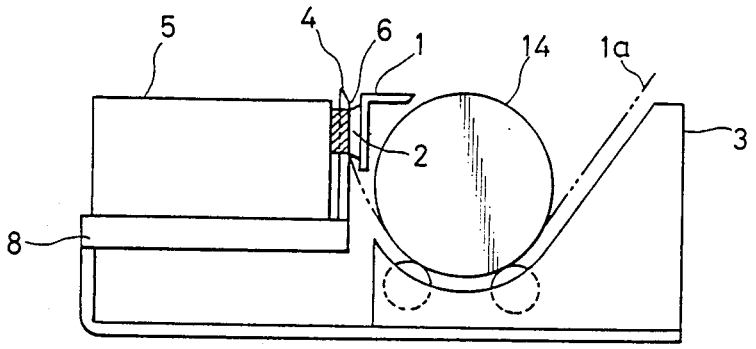
FIGS. 3A and 3B are side views of the thermal printer under a head down and a head up condition, respectively.
Figure 3B:
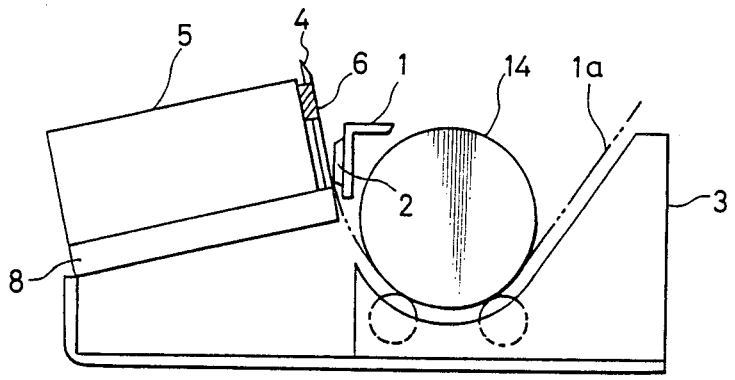

Under the condition as mentioned above, when the pulse motor 13 is driven, the rotating mechanism of the carriage 5 is operated to rotate the carriage 5 clockwise as shown in FIG. 3A. Accordingly, the thermal head 4 abuts against the platen rubber 2 with the ink ribbon 6 sandwiched therebetween, and the thermal head 4 is maintained in a head down condition where transfer to the recording paper 1*a*, that is, a printing operation, or erasure of a record on the recording paper 1*a*, that is, a correcting operation may be carried out.

In carrying out the printing operation or the correcting operation, the clutch mechanism 16 is selected to transmit the torque of the pulse motor 13 through the gear set 15 and the clutch mechanism 16 to the carriage moving mechanism, thereby moving the carriage 5 along the platen 1 or the platen rubber 2.

Figure 5A:
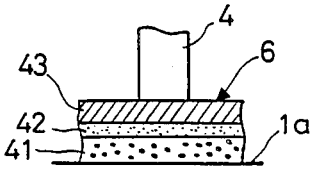
FIGS. 5A and 5B are illustrations of the printing operation of the thermal printer.
Figure 5B:
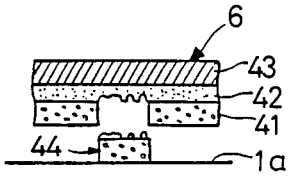

In starting the printing operation from the ready position as shown in FIG. 3A, the ink ribbon 6 is pressed by the thermal head 4 in such a manner that the ink layer 41 is opposed to the recording paper 1*a* as shown in FIG. 5A. At this time, the solenoid 19 of the guide mechanism 17 remains OFF, and the roller 30 is therefore separated from the recording paper 1*a*. Accordingly, the ink ribbon 6 is designed to be peeled off from the recording paper 1*a* just after passing through the thermal head 4. Under the condition as mentioned above, when a printing energy of about 20–35 mj/mm$^2$ for example is applied to the thermal head 4, the ink layer 41 and the release layer 42 are molten. Then, the ink ribbon 6 is peeled off from the recording paper 1*a* under the above condition where the temperature of the ink ribbon 6 is maintained at about 150°–250° C. As a result, there occur interfacial fracture between the ink layer 41 and the release layer 42 and cohesive fraction in the release layer 42, thus obtaining a desired record 44 transferred onto the recording paper 1*a* from the ink layer 41 as shown in FIG. 5B.

Figure 6A:
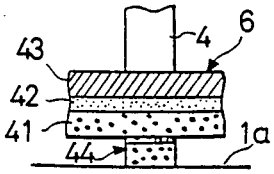
FIGS. 6A, 6B and 6C are illustrations of the correcting operation of the thermal printer.
Figure 6B:
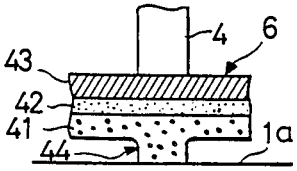
Figure 6C:
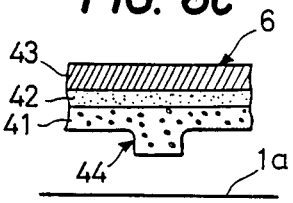

In carrying out the correcting operation to correct the record 44 transferred onto the recording paper 1*a*, the ink ribbon 6 is pressed by the thermal head 4 in such a manner that the ink layer 41 is opposed to the record 44 printed on the recording paper 1*a* as shown in FIG. 6A. Then, the solenoid 19 of the guide mechanism 17 is turned ON to press the roller 30 against the recording paper 1*a* as mentioned previously. Accordingly, the ink ribbon 6 is pressed on the recording paper 1*a* even on the downstream side of the thermal head 4. In other words, even after the ink ribbon 6 passes through the thermal head 4, it is maintained in contact with the recording paper 1*a* for a certain period of time. Thereafter, when an erasing energy greater than the printing energy, about 35–55 mj/mm$^2$ foe example is applied to the thermal head 4, the ink layer 41 and the release layer 42 are molten in an area greater than that in the printing operation. Therefore, the molten ink layer 41 is bonded to the record 44 as shown in FIG. 6B. Since the erasing energy is greater than the printing energy as mentioned above, the area of the ink layer 41 to be molten by the same heat generating element 4*a* in the correcting operation is greater than that in the printing operation, and accordingly the molten ink layer 41 can completely cover the record 44 to be erased. Thereafter, the ink ribbon 6 is allowed to pass through the heat generating element 4*a* of the thermal head 4, and is maintained in contact with the recording paper 1*a* by the roller 30. As a result, the temperature of the ink ribbon 6 decreases less than the melting point of the release layer 42, and the release layer 42 is solidified. Under the condition, the ink ribbon 6 is peeled off from the recording paper 1*a* as shown in FIG. 6C. As a result, the record 44 printed on the recording paper 1*a* is moved away from the recording paper 1*a* integrally with the ink ribbon 6. Thus, the erasure is completed.

As is described above, the guide mechanism 17 for the ink ribbon 6 in this embodiment includes the arm driving spring 26 as an elastic member provided in a path of transmission of a driving force to be transmitted from the solenoid 19 as a drive source to the roller 30 as an ink ribbon guide, that is, interposed between the lever 25 and the arm 33. Accordingly, when the solenoid 19 is energized when the condition where the roller 30 is separated from the recording paper 1*a*, a rapid operation of the driving shaft 18 and the lever 25 is damped by the arm driving spring 26. Then, the arm driving spring 26 starts being extended to gradually rotate the arm 33. That is, the roller 30 is softly gradually brought into contact with the recording paper 1*a*. Therefore, it is possible to solve the conventional problems of slack or cut of the ink ribbon 6 upon pressure contacting of the roller 30 against the recording paper 1*a*.

Furthermore, since the pressure contact force of the roller 30 against the recording paper in this embodiment is generated by the arm driving spring 26, a change in thickness of the recording paper and surface roughness may be absorbed by the arm driving spring 26, thereby obtaining a satisfactory pressure contact force at all times.

Various modifications may be made in the present invention. For instance, the solenoid 19 as the drive source may be replaced by a motor and a cam.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a thermal printer including a thermal head movable in a scanning direction along a platen supporting a recording paper thereon, an ink ribbon having a thermally transferrable ink layer interposed between said thermal head and the recording paper for effecting printing by application of heat from said thermal head to said ink ribbon to transfer ink from the ink layer to the paper, a ribbon guide roller movable toward and away from said platen for guiding said ink ribbon to be pressed toward the paper and separated therefrom on a downstream side of said thermal head with respect to the scanning direction of said thermal head, and operating means for operating said ribbon guide roller for an erasing operation so as to move it in pressure contact for holding said ink ribbon in contact with the paper on the downstream side of said thermal head to allow ink on the paper to bond to the ink layer and, subsequently, to be lifted off from the paper, the improvement wherein said operating means for said ribbon guide roller comprises:

a pivotable arm (33) supporting said ribbon guide roller on one end portion and having a second end portion thereof which is movable so as to pivot said first end portion;

a pivotable lever (25) having a first portion, and a second portion which is actuatable so as to pivot said first end portion;

a solenoid (19) connected to said second portion of said lever which is actuatable ON and OFF for pivoting said first portion of said lever to a pivoted position and for releasing said lever back to a release position, respectively;

an arm driving spring (26) connected between said second end portion of said arm and said first portion of said lever for transmitting the force of said first portion of said lever, when pivoted to said pivoted position by actuation of said solenoid ON, through a tensile spring constant of said arm driving spring to said second end portion of said arm, whereby said ribbon guide roller on said first end portion of said arm is pressed against the ink ribbon and the paper on said platen through the tensile force of said arm driving spring, which dampens the transmitted force and ensures that said ribbon guide roller is gradually brought into pressure contact with the paper in order to avoid cutting said ink ribbon and to accomodate different thicknesses of paper.

2. A thermal printer according to claim 1, wherein said operating means for said ribbon guide roller includes said first portion of said lever having a first projection thereon, said second end portion of said arm having a second projection thereon, and said arm driving spring being connected between said first and second projections, and further comprising a return spring (24) for returning said lever to the release position when said solenoid is deactuated OFF, and a stopper member (29) provided with a hole on one end in which said first projection of said first portion of said lever is loosely retained and with a slit on another end thereof in which said second projection of said second end portion of said arm is slidably retained, said slit having a base side which abuts against said second projection when said solenoid is deactuated OFF and said lever is pivoted to the release position by said return spring, in order to positively pivot said arm to separate from the paper on said platen.

* * * * *